United States Patent [19]

Siefert et al.

[11] Patent Number: 4,821,156

[45] Date of Patent: Apr. 11, 1989

[54] FLASHLIGHT WITH FOCUSING BEAM ASSEMBLY

[75] Inventors: Steven G. Siefert, Half Moon Bay; Ralph F. Osterhout, San Francisco, both of Calif.

[73] Assignee: Tekna, Redwood City, Calif.

[21] Appl. No.: 181,281

[22] Filed: Apr. 14, 1988

[51] Int. Cl.[4] ..... F21L 7/00

[52] U.S. Cl. ..... 362/187; 362/205

[58] Field of Search ..... 362/187, 202, 204, 205; 200/60

[56] References Cited

U.S. PATENT DOCUMENTS 4,398,238 8/1983 Nelson ..... 362/187

4,429,351 1/1984 Petzl et al. ..... 362/205

*Primary Examiner*—Allen M. Ostrager

*Attorney, Agent, or Firm*—Townsend and Townsend

[57] ABSTRACT

A flashlight includes a focusing beam assembly which is diposed between an elongate casing holding the batteries and a lens cowl enclosing an open end of the casing. The focusing beam assembly includes a parabolic reflector slidably mounted within a base. A spring urges the reflector forward relative to the base so that a light bulb mounted in the base is normally at a first position relative to the reflector. By tightening the lens cowl on the casing, the reflector can be compressed against the spring relative to the base so that the position of the light bulb relative to the reflector is changed. In this way, the beam width emanating from the flashlight can be adjusted.

11 Claims, 3 Drawing Sheets

FLASHLIGHT WITH FOCUSING BEAM ASSEMBLY

BACKGROUND OF THE INVENTION

The present invention relates to the construction of flashlights and, more particularly, to a mechanism for allowing adjustment of the beam width provided by the flashlight.

U.S. Pat. Nos. 4,658,336 and 4,577,263 both describe a flashlight having a beam which adjusts by twisting a face cap at the forward end of the flashlight. Although generally functional, the design of the flashlights suffers from certain disadvantages. The receptacle holding the light bulb at the front of the flashlight is not removable, requiring that a separate end cap be provided for replacing batteries. Such a design is more expensive to fabricate and requires an additional seal in immersible units. Additionally, the receptacle holding the light bulb in the flashlight is not replaceable, complicating the repair should the focusing beam mechanism be damaged. Also, in the event of failure, the fragile light bulb must be separately replaced as it is part of no larger replacement unit. Finally, if the face cap is removed from the flashlight, the light bulb is exposed and subject to breakage.

Tekna, Redwood City, CA, sells a product line of miniature flashlight identified as the Tekna Lite TM 2, Micro-Lite TM, and Mono-Lith TM, which consists of a flashlight casing, a beam assembly, and a lens cowling which attaches to the forward end of the casing, urging the beam assembly against the batteries therein. The flashlight operates by urging the beam assembly rearward against a pair of fixed conductors axially aligned within the casing. When a conductive ring on the back of the beam assembly is brought into contact with the conductors, the light bulb in the beam assembly is energized. The parabolic reflector and light bulb within the beam assembly, however, are positionally fixed relative to one another, and no provision is made for beam width adjustment.

It would be desirable to provide a flashlight construction having a focusing beam mechanism, where the focusing beam mechanism can be completely removed from the forward end of the flashlight casing to allow for battery replacement. Such a construction eliminates the need for a detachable rear cap, reducing the number of seals required to provide an immersible unit. It would be further desirable that the focusing beam assembly be provided in a self-contained unit which would allow for replacement of the unit should a failure occur in the focusing beam mechanism. Such a construction would also eliminate the need for separately replacing fragile flashlight bulbs and would greatly limit the exposure of such bulbs to breakage when the flashlight unit is partially disassembled. Such a self-contained focusing beam assembly would also allow replacement of fixed beam assemblies in previously constructed flashlights when it is desired to add a focusing beam capability. It would further allow the user the option of selecting a fixed beam assembly or a focusing beam assembly as desired.

SUMMARY OF THE INVENTION

According to the present invention, a flashlight includes a focusing beam assembly capable of selectively adjusting the beam width. Usually, the focusing beam assembly will be an integral unit capable of being completely removed from the remainder of the flashlight and replaced or interchanged with a non-focusing beam assembly. In this way, there is no need to provide a separate detachable end cap on the flashlight for battery replacement, and the focusing beam assembly may be easily removed and replaced in the event the assembly or the light bulb fails.

The flashlight includes an elongate casing which holds one or more batteries in series therein. A spring disposed at the rear of the casing urges the batteries in the forward direction. At the front of the flashlight, a parabolic reflector capable of axial translation circumscribes a light bulb. The light bulb contacts one pole of the batteries and moves with them at all times. The parabolic reflector moves separately from the light bulb, and a second spring biases the parabolic reflector in the forward direction relative to the light bulb in the batteries. A lens cowl is placed over the forward end of the casing and engages the parabolic reflector. By screwing in the lens cowl in the rearward direction, the parabolic reflector is urged rearward. Initially, the rearward motion is transmitted through the reflector spring to the light bulbs and batteries. Thus, the reflector, light bulb, and batteries move rearward in unison until a conductor coupled to the light bulb engages a battery contact fixed to the casing. The contact completes the circuit to the light bulb and prevents further motion of the light bulb and batteries. The reflector, however, is able to continue moving rearward, thus affecting beam width adjustment as the light bulb moves relative to the focus of the parabolic reflector.

In the preferred embodiment, the parabolic reflector, light bulb, and reflector spring are included in a focusing beam assembly further comprising a base which carries the electrical connector. The light bulb is fixed at the base and receives one end of the spring, the other end of which urges the parabolic reflector away from the base. Thus, even when the conductor on the base contacts the fixed electrical contact, the parabolic reflector is able to continue rearward movement by compressing the reflector spring. Such a self-contained focusing beam assembly provides all of the advantages discussed above.

DESCRIPTION OF THE SPECIFIC EMBODIMENTS

Figure 1:
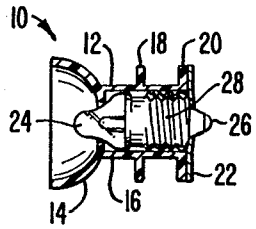
FIG. 1. PRIOR ART
FIG. 1 illustrates the prior art fixed beam assembly used in the Tekna Lite 2, described above.

Referring to FIG. 1, a fixed beam assembly 10 of the type employed in the Tekna Lite 2, described hereinabove, includes a parabolic reflector unit 12 including the reflector 14 and a shank portion 16. A pair of flanges 18 and 20 are provided on the flank, and a conductor ring 22 is provided on a rear face of the second flange 20. A light bulb 24 is threadably received in the shank portion 16 and includes a terminal 26 projecting rearward beyond the second flange 20. The conductor ring 22 is electrically coupled to the second terminal 28 of the light bulb which is received in the shank 16. As can be seen, once the light bulb 24 is screwed into place, the light bulb is incapable of movement relative to the reflector 14.

Figure 2:
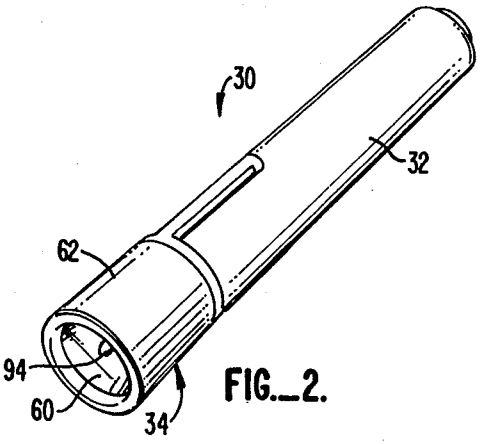
FIG. 2 is a perspective view of a flashlight constructed in accordance with the principles of the present invention.
Figure 3:
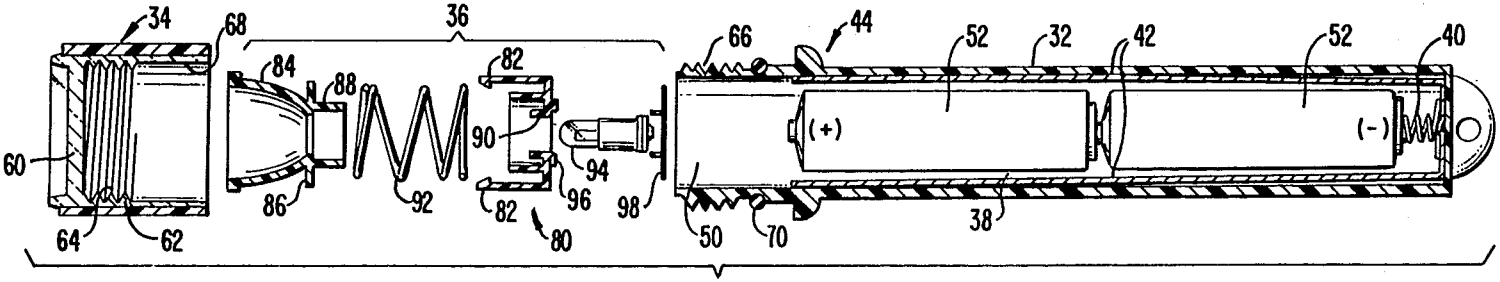
FIG. 3 is an exploded view of the flashlight of FIG. 2.

Referring now to FIGS. 2 and 3, a flashlight 30 includes an elongate casing 32, a lens cowl 34, and a focusing beam assembly 36 (shown in an exploded view in FIG. 3). The elongate casing 32 defines an internal axial chamber 38 having a battery spring 40 at its rearward (to the right in FIG. 3) end. The battery spring 40 is electrically coupled to a pair of rigid electrical conductors which extend from the rear end of the casing 32 to a termination point 44 proximate open forward end 50 of the casing. The axial chamber 38 is adapted to receive one or more batteries 52 (with two being illustrated) held in series with one pole (marked −) of the battery being in contact with battery spring 40. In this way, contact with that battery pole may be achieved through the termination ends of conductors 42. The other battery pole (marked +) is located at the forward end of the casing at approximately the termination location 44.

Lens cowl 34 includes a transparent lens element 60 and a cylindrical skirt 62. A threaded portion 64 of the interior surface of skirt 62 mates with threaded portion 66 on the outside of the forward end of casing 32. A smooth portion 68 on the interior surface of skirt 62 will engage an O-ring seal 70 on the casing 32. Thus, the lens cowl 34 may be threaded onto the casing 32 with a water-proof seal being provided by the O-ring 70. The seal will remain water tight while the lens cowl 34 may be axially adjusted by turning relative to the casing 32.

The focusing beam assembly 36 includes a base element 80 having a plurality of hooks 82 extending from its periphery. Parabolic reflector 84 includes a flange 86 and rear shank 88. The flange is received within hooks 82 on base 80 and the shank is shorter than the length of hooks 82. Thus, the reflector 84 may move axially within the base with one limit of travel being provided by the hooks 82 and the other limit of travel being provided when the shank 88 engages the rear or bottom surface 90 of the base 80. A reflector spring 92 will be disposed between the rear surface 90 of the base 80 and the flange 86. In this way, the reflector 84 is normally in its forward or extended position relative to the base, unless a force is applied on the reflector to compress the spring 92. Light bulb 94 is threadably received in an aperture 96 in the base 80. A conductor ring 98 is provided about the periphery of the base and is electrically coupled to the side pole of light 94.

Figure 4A:
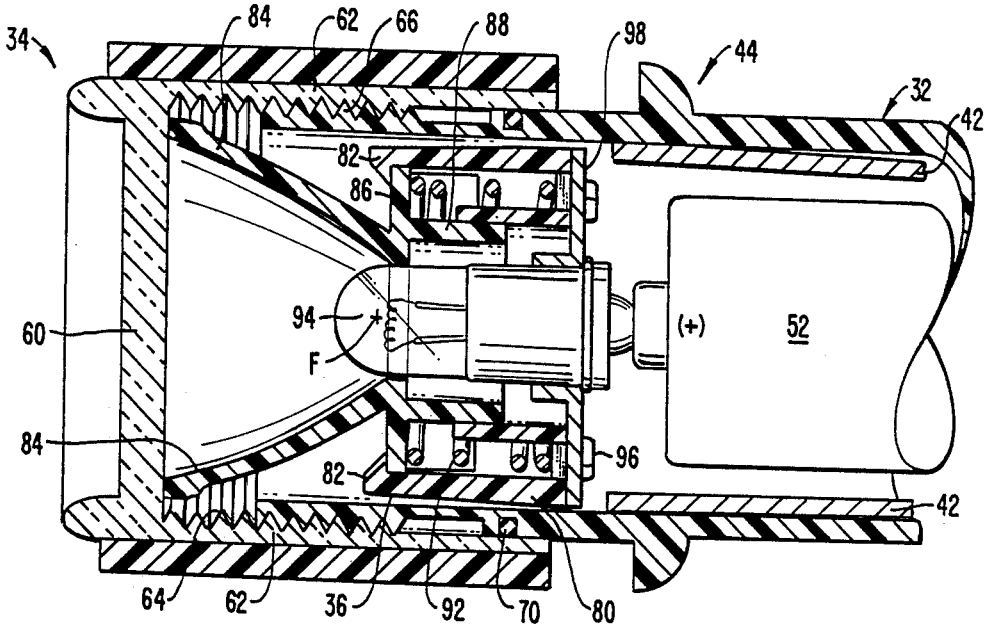
FIGS. 4A–4C illustrate the operation of the flashlight of FIG. 2, with FIG. 4A showing the flashlight in an off (unenergized) configuration, FIG. 4B illustrating the flashlight in an on (energized) configuration with a first beam focused, and FIG. 4C illustrating the flashlight in the on (energized) configuration in a second beam focus configuration.
Figure 4B:
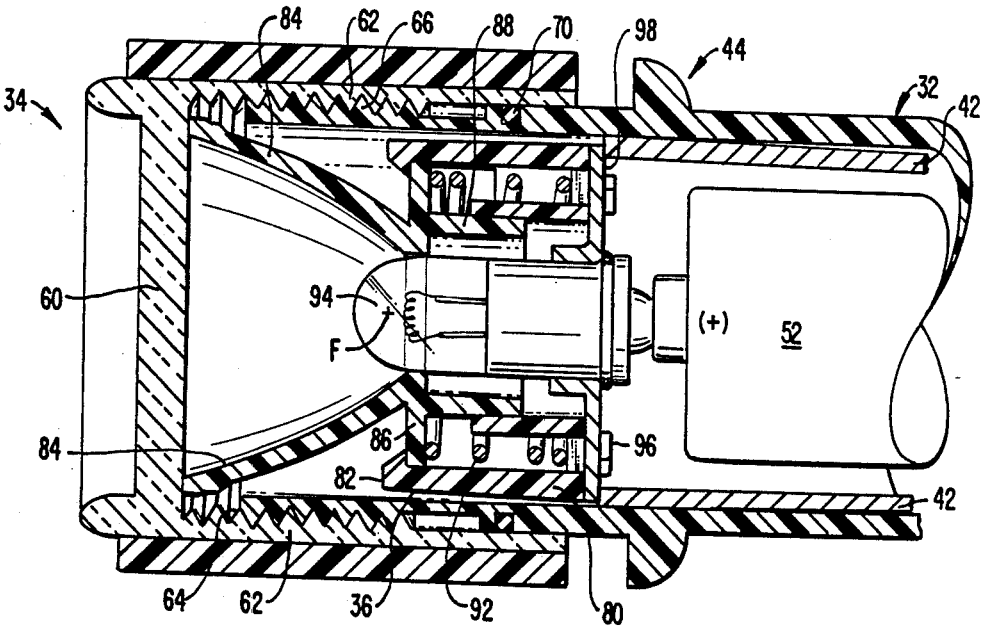
Figure 4C:
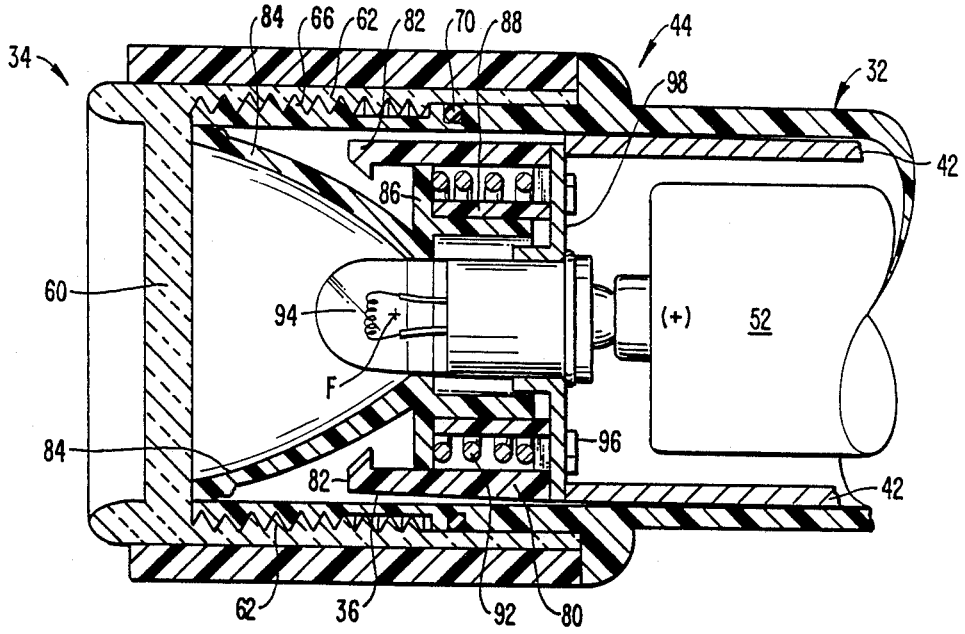

Referring now to FIGS. 4A–4C, the operation of the flashlight of the present invention will be described. In FIG. 4A, cowling 34 is disposed generally in the forward or rightward direction relative to casing 32. The focusing beam assembly 36 is also urged in the forward direction by contact with batteries 52, which in turn are being urged forward by battery spring 40. The parabolic reflector 84 is also in the extended or forward configuration relative to base 80 because the reflector spring 92 has a greater spring constant than the battery spring 40. The light bulb 94 will not be energized in this configuration. Although the battery pin is in contact with the positive (+) terminal of the batteries, the side terminal of the light is disconnected. That is, conductor ring 98 is out of contact with the rigid conductors 42. In this configuration, the filament of the light bulb 94 is disposed behind (toward the bottom of the flashlight) the focus F of the parabolic reflector.

Referring now to FIG. 4B, the flashlight may be turned on by twisting lens cowl 34 so that the lens cowl is moved in the rearward or leftward direction. Movement of the lens cowl 34 urges the focusing beam assembly 36 in the rearward direction, resulting in the compression of battery spring 40. Such motion continues until the conductor plate 98 on base unit 80 engages the terminals of conductors 42, as illustrated in FIG. 4B. The light will then be turned on with the reflector 84 still in its fully extended, forward configuration. The filament of bulb 94 remains to the rear of focus F, just as in the off configuration of FIG. 4A.

Referring now to FIG. 4C, further turning will cause the lens cowl 34 to move additionally in the rearward direction. As movement of the base unit 80 is now prevented by the rigid conductors 42, the force against reflector 84 will compress the reflector spring 90. Moreover, as the light bulb 94 is positionally fixed relative to the base unit 80 and batteries 52, so that the reflector 84 will move relative to the light bulb 94. In this way, the filament of the light bulb 94 moves relative to the focus F of the parabolic reflector 84, changing the beam width which is generated. Specifically, the filament moves from a rearward orientation (as illustrated in FIGS. 4A and 4B), through the focus F (not illustrated), to a position forward of the focus (as illustrated in FIG. 4B). The beam will be at its narrowest when the filament is closest to the focus F, and will diverge as the filament is moved away from the focus in either direction. Thus, the beam width may be adjusted by moving the lens cowl 34 in the forward and rearward directions. Also, the flashlight may be turned off by moving the lens cowl 34 sufficiently in the forward direction so that contact between conductor ring 98 and rigid conductors 42 is broken.

Although the foregoing invention has been described in some detail by way of illustration and example for purposes of clarity of understanding, it will be obvious that certain changes and modifications may be practiced within the scope of the appended claims.

What is claimed is:

1. A flashlight comprising:

an elongate casing having an axial chamber capable of holding one or more batteries in series, said casing being open at a forward end and closed at a rearward end;

a battery spring disposed at the rearward closed end of the axial chamber for biasing the batteries in the forward direction;

a parabolic reflector mounted in the open forward end of the casing and capable of axial translation relative thereto;

a light bulb disposed within the parabolic reflector and contacting the batteries;

a reflector spring disposed at the forward open end of the casing for biasing the parabolic reflector in the forward direction relative to the batteries;

a lens cowl secured over the open forward end of the casing and engaging the parabolic reflector, said lens cowl being positionable in the axial direction whereby rearward motion of the cowl first moves the reflector, light bulb and batteries until contact is established energizing the light bulb and second moves the reflector rearward relative to the light bulb and batteries to change beam focus.

2. A flashlight as in claim 1, further comprising a terminal electrically coupled to the batteries, which terminal engages the light bulb as it is translated rearward to both energize the light bulb and stop movement of the light bulb relative to the reflector.

3. A flashlight as in claim 1, wherein the battery spring has a lower spring constant than the reflector spring so that battery spring is compressed before the reflector spring.

4. A flashlight as in claim 1, wherein the closed rearward end is formed integrally with the casing so that batteries are passed through the open forward end.

5. A flashlight comprising:

an elongate casing having an open forward end and a closed rearward end;

means for biasing one or more batteries held in series in the forward direction;

means for electrically coupling a first pole of the batteries to a fixed terminal near the open forward end of the casing;

a lens cowl secured over the open forward end of the casing, said lens cowl being positionable in the axial direction;

a focusing beam assembly slidably received in the open end of the casing and disposed between the fixed terminal and the lens cowl, said assembly including:

(a) a base;

(b) a light bulb secured in the base;

(c) electrically conductive means on the base coupled with a second pole of the light bulb;

(d) a parabolic reflector circumscribing the light and mounted on the base to shift between an extended forward position and a retracted rearward position; and (e) biasing means coupled between the base and the reflector so that the reflector is urged toward its extended forward position;

whereby moving the lens cowl in the rearward direction first contacts the conductive means on the base with the fixed terminal in the casing to activate the light bulb and thereafter moves the parabolic reflector rearward relative to the light bulb to change the focus.

6. A flashlight as in claim 5, wherein the means for biasing is a first helical spring disposed against the closed rearward end of the casing.

7. A flashlight as in claim 6, wherein the means for electrically coupling a first pole of the batteries to a fixed terminal includes a pair of rigid conductors extending from the helical spring and terminating proximate the open forward end of the casing, whereby the conductors engage the electrically conductive means on the base of the focusing beam assembly to prevent further rearward movement of the base and energize the light bulb.

8. A flashlight as in claim 5, wherein the lens cowl is threadably received over the open end of the casing.

9. A flashlight as in claim 5, wherein the biasing means coupled between the base and the reflector is a second helical spring having a spring constant greater than the first helical spring.

10. An improved flashlight of the type including an elongate casing, a lens cowl secured over an open forward end of the casing, and a beam assembly slidably secured between the lens cowl and a fixed battery connection terminal within the casing, said improvement comprising a beam assembly including a base, a parabolic reflector movable relative to the base, and a light bulb fixed relative to the base, whereby movement of the lens cowl changes the relative position of the reflector and the light bulb to adjust the beam focus.

11. A focusing beam assembly for use in combination with a flashlight including an elongate casing and an axially adjustable lens cowl at one end, said assembly comprising:

a base;

a light bulb secured in the base;

an electrically conductive means on the base coupled with a first pole of the light bulb;

a parabolic reflector circumscribing the light and mounted on the base to shift between an extended forward position and a retracted rearward position; and biasing means coupled between the base and the reflector so that the reflector is urged toward its extended forward position.

* * * * *